US006925918B1

(12) United States Patent
Bunge

(10) Patent No.: US 6,925,918 B1
(45) Date of Patent: Aug. 9, 2005

(54) SCRAP STRIPPER FOR A ROTARY CUTTING DEVICE FOR CUTTING CORRUGATED BOARD

(75) Inventor: Jeffery Scott Bunge, Ottawa Lake, MI (US)

(73) Assignee: Container Graphics Corporation, Cary, NC (US)

( * ) Notice: Subject to any disclaimer, the term of this patent is extended or adjusted under 35 U.S.C. 154(b) by 25 days.

(21) Appl. No.: 10/640,933

(22) Filed: Aug. 14, 2003

(51) Int. Cl.[7] ..... B26D 7/18
(52) U.S. Cl. ..... 83/116; 83/128; 83/139
(58) Field of Search ..... 83/116, 117, 118, 83/128, 139, 653; 493/342

(56) References Cited

U.S. PATENT DOCUMENTS 3,827,322 A * 8/1974 Saunders et al. ..... 83/128
5,111,725 A * 5/1992 Simpson et al. ..... 83/117
5,365,815 A * 11/1994 Pfaff, Jr. ..... 83/154
5,636,559 A * 6/1997 Smithwick et al. ..... 83/116
6,644,153 B1 * 11/2003 Gordon ..... 83/27

* cited by examiner

*Primary Examiner*—Allan N. Shoap
*Assistant Examiner*—Carolyn Blake
(74) *Attorney, Agent, or Firm*—Coats & Bennett, P.L.L.C.

(57) ABSTRACT

A die board on a rotary cutting die includes one or more scrap strippers to remove scrap from adjacent cutting blades secured to the die board. The rotary cutting die cooperates with a rotary anvil to cut corrugated board directed through a nip. Each scrap stripper includes a compressible base with a compressible post inserted into and extending from an opening in the base. As the corrugated board is directed through the nip, each scrap stripper compresses, causing the post(s) to flex against a scrap area and crease the scrap area while the cutting blade(s) cut the scrap area. As the scrap stripper exits the nip, the scrap stripper expands and strips the cut scrap piece from the cutting blade(s) and the corrugated board.

21 Claims, 7 Drawing Sheets

SCRAP STRIPPER FOR A ROTARY CUTTING DEVICE FOR CUTTING CORRUGATED BOARD

BACKGROUND OF THE INVENTION

Rotary or drum-type cutting dies are commonly used for producing a container or carton from a blank of corrugated board sheet material. Such rotary dies typically comprise a pair of cooperating cylinders or drums. One of the cylinders, a cutting cylinder, includes a die board having cutting blades or scoring rules while the other, the anvil cylinder, provides a backing surface against which the corrugated board is cut.

Rotary cutting dies of the type described above are often employed to produce slots or various shaped openings in the sheet of corrugated board material that is being processed. As such, rotary cutting dies often include provisions for removing or stripping severed scrap material from certain cutting blades and the processed sheet of corrugated board. If the severed scrap material is not actively removed from the vicinity of the cutting die, the scrap material tends to collect around the cutting blades, rendering the rotary cutting die inoperable.

SUMMARY OF THE INVENTION

The following discloses a method and an apparatus for removing scrap from the final corrugated product and from cutting blades secured to a die board on a rotary cutting die. The rotary cutting die cooperates with a rotary anvil to cut corrugated board directed through a nip defined between the rotary cutting die and the rotary anvil. The die board includes at least one scrap stripper mounted to the die board adjacent to one or more of the cutting blades. The scrap stripper operates to strip the scrap piece from the cutting blade(s) and the corrugated board as the cut scrap piece exits the nip. Each scrap stripper includes a compressible base with a flexible and compressible post extending from the base. The compressible post is movable between a flexed position and an extended position.

As the corrugated board is directed through the nip, each scrap stripper compresses, causing the post on each scrap stripper to flex against a scrap area and crease the scrap area. The cutting blade(s) cut the scrap area to form a corrugated scrap piece. As the scrap stripper exits the nip, the scrap stripper expands and strips the corrugated scrap piece from the cutting blade(s) and the processed corrugated board.

Other objects and advantages of the present invention will become apparent and obvious from a study of the following description and the accompanying drawings which are merely illustrative of such invention.

BRIEF DESCRIPTION OF THE DRAWINGS

FIG. 4A illustrates the relative positioning and orientation of the scrap stripper and blank of corrugated board before the scrap stripper enters the nip.

FIG. 4B illustrates a scrap stripper entering the nip between the rotary cutting die and the anvil.

FIG. 4C illustrates the scrap stripper being compressed between the die board and the corrugated material as the scrap stripper moves though the nip and as the lead cutting blade begins cutting the corrugated board.

FIG. 4D illustrates the fully compressed scrap stripper between the die board and a cut piece of scrap as the scrap stripper moves through the nip.

FIG. 4E illustrates the scrap stripper being expanded as it continues to hold the cut piece of scrap against the downwardly rotating anvil cylinder as the scrap stripper exits the nip.

FIG. 4F illustrates the expanded scrap stripper ejecting the cut piece of scrap material.

FIG. 5A illustrates the relative positioning and orientation of the scrap stripper and incoming blank of corrugated board material before entering the nip.

FIG. 5B illustrates a partially compressed scrap stripper engaging corrugated board material as it passes through the nip.

FIG. 5C illustrates a fully compressed scrap stripper and a creased and cut piece of scrap as the scrap stripper moves through the nip.

FIG. 5D illustrates an expanding scrap stripper as it pushes the cut scrap away from the cutting blades.

FIG. 5E illustrates a fully expanded scrap stripper ejecting the scrap from the nip.

DETAILED DESCRIPTION OF THE INVENTION

Figure 1:
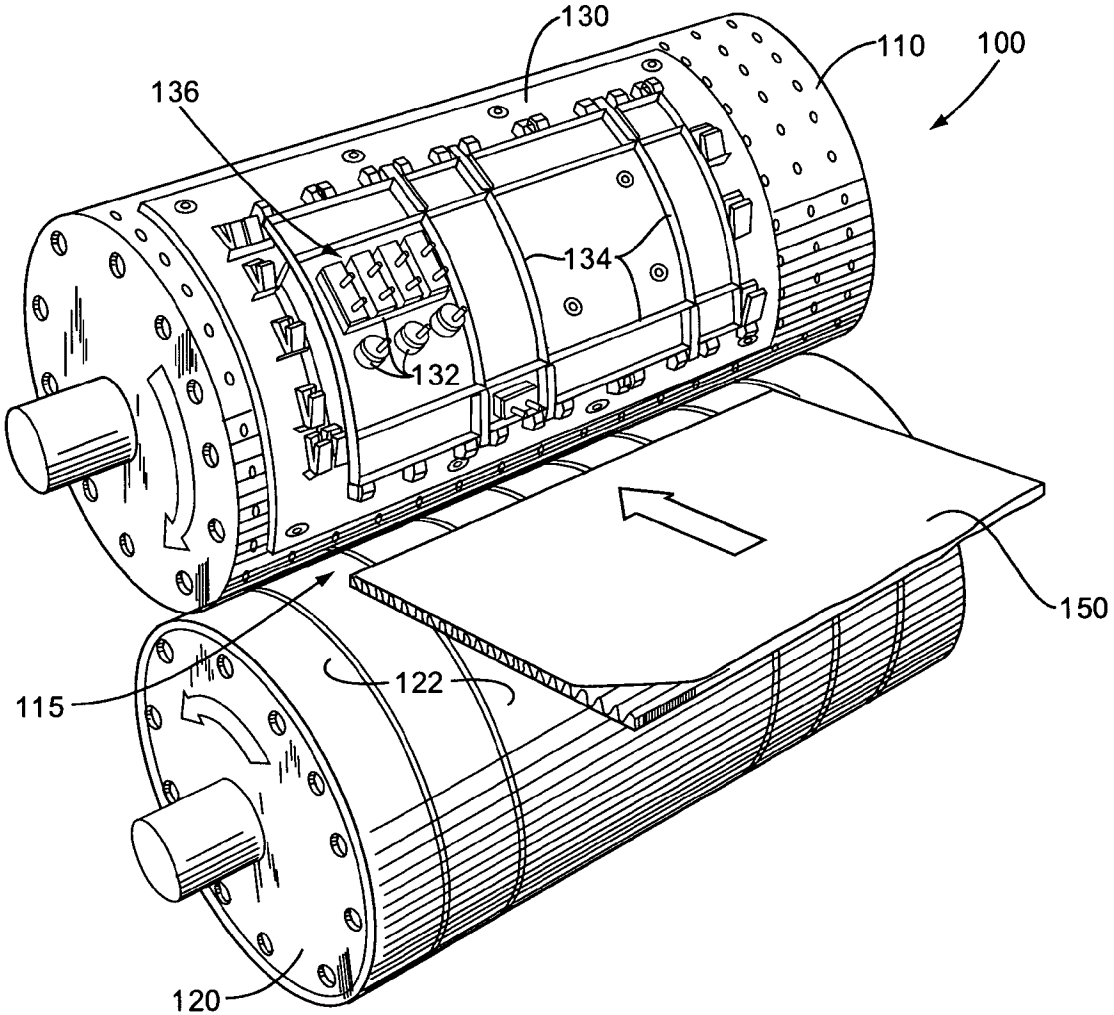
FIG. 1 illustrates a perspective view of a corrugated board rotary cutting die that incorporates compressible scrap strippers according to the present invention.

FIG. 1 illustrates a rotary die cutting apparatus 100 for cutting a corrugated board 150. The rotary die cutting apparatus 100 comprises a pair of rotatably mounted, cooperating cylinders or drums. More particularly, rotary die cutting apparatus 100 includes a cutting cylinder 110 and an anvil 120. Cutting cylinder 110 is at least partially surrounded by a generally cylindrical cutting board or die board 130. Secured around the anvil 120 in conventional fashion is a layer of urethane 122, or other suitable material, against which die board 130 cuts corrugated board 150.

Typically, cutting cylinder 110 and anvil 120 are disposed closely adjacent to each other so as to define a nip 115 between cutting cylinder 110 and anvil 120. In conventional corrugated board die cutting operations, cutting cylinder 110 and anvil 120 are driven in opposite directions at essentially the same surface speed while sheets of corrugated board 150 are fed through nip 115. As corrugated board 150 passes through nip 115, die board 130 cuts and scores the corrugated board 150 according to a predetermined pattern. In cutting the corrugated board 150, the cutting blades carried by the die board 130 press against the urethane 122 secured to anvil 120. In scoring the corrugated board 150, scoring rules on die board 130 press against the corrugated board 150. Thus in conventional fashion, the sheets of corrugated board 150 are trimmed, scored, slitted, etc., so as to produce a corrugated finished product along with cut scrap.

A series of knives or cutting blades 132 and scoring rules 134 (see FIG. 1) disposed on die board 130 cut and score selective areas of the corrugated board 150 fed into nip 115. Die board 130 also carries trim cutting blades that trim one or more edges from the blank corrugated board 150. Further, die board 130 includes various trim and scrap strippers 136 and product ejectors. While, for simplicity, the product ejectors are not shown in FIG. 1, those skilled in the art will appreciate that such product ejectors are typically incorporated into die board designs. As is well known in the art, scrap strippers 136 typically function to strip cut scrap from adjacently disposed cutting blades 132 and from the processed corrugated board. The product ejectors act to eject the final corrugated product from the cutting blades 132 that extend from die board 130. According to the present invention, die board 130 may be provided with a series or array of scrap strippers, such as the group of scrap strippers 136 disposed within the confines of a cutting blade network 132 that is effective to cut a slot or opening from a sheet of incoming corrugated board 150. In addition, die board 130 may include individual scrap strippers, where each scrap stripper is disposed within the confines of a cutting blade 132.

Figure 2A:
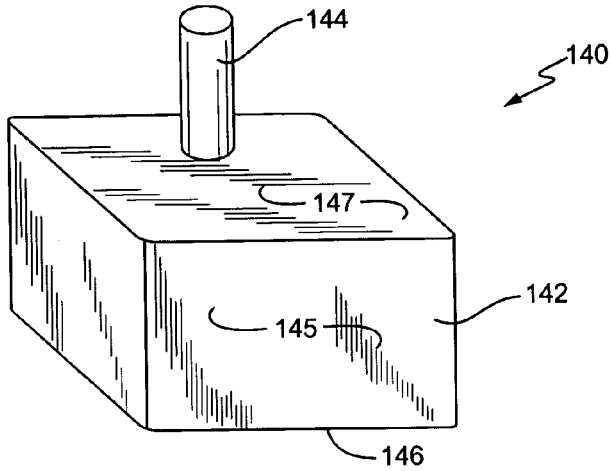
FIG. 2A illustrates a perspective of an exemplary scrap stripper according to the present invention.
Figure 2B:
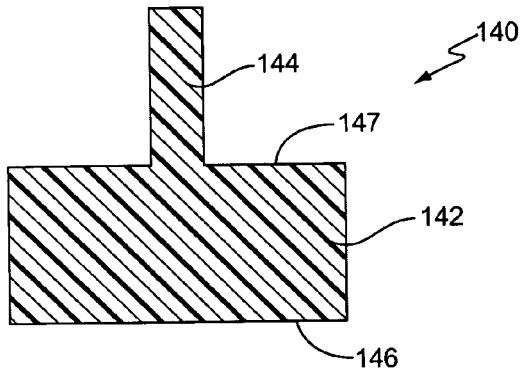
FIG. 2B illustrates a cross-sectional view of the exemplary scrap stripper of FIG. 2A.

FIGS. 2A–2B illustrate an exemplary scrap stripper 140 according to the present invention. Scrap stripper 140 comprises a compressible base 142 and a compressible and flexible post 144. Base 142 comprises sides 145, a horizontal mounting surface 146, and a generally horizontal top surface 147. Post 144 extends from, and generally perpendicular to, the top surface 147 of base 142. In some embodiments, post 144 is offset from the center of base 142 to provide room for post 144 to flex and compress without extending over adjacent cutting blades. As shown in FIG. 2B, base 142 and post 144 may be manufactured from a solid piece of a compressible material utilizing a one-piece molding or machining type process, such that the base and post are infused or constructed from one piece of material. Exemplary compressible materials include 75–90 durometer rubber polymers on the shore 00 scale, such as white urethane.

In an alternate embodiment, scrap strippers 140 may also be manufactured from two or more materials (see FIGS. 4A–4F) and assembled to form the scrap stripper 140. In this embodiment, base 142 includes one or more openings 148 for receiving one or more posts 144. In a preferred embodiment, openings 148 extend through base 142 from the top surface 147 to the mounting surface 146. The posts 144 may be frictionally secured within the openings 148. Alternatively, the posts 144 may be secured within the openings 148 with an adhesive. The multi-piece scrap strippers 140 are typically fabricated of a 75–90 durometer rubber polymer on the shore 00 scale. In an exemplary embodiment, base 142 may be fabricated from rubber, a 75–85 durometer (on the shore 00 scale) white urethane, or other suitable material, while posts 144 may be fabricated from an 80–90 durometer (on the shore 00 scale) white urethane. Alternately, posts 144 may be fabricated from latex tubing, silicon tubing, tube punch rubber tubing, or any other suitable material.

Figure 3A:
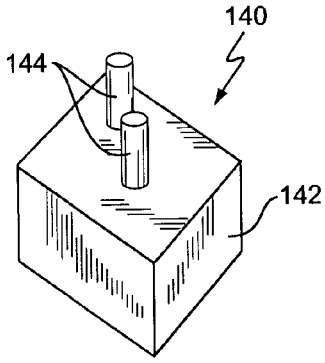
FIGS. 3A–3C illustrate perspectives of exemplary scrap strippers according to the present invention.
Figure 3B:
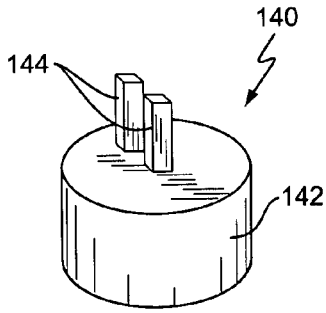
Figure 3C:
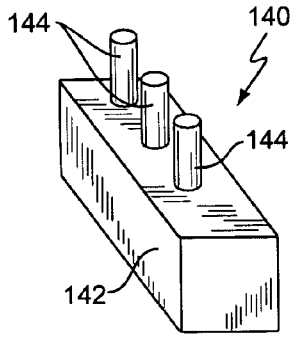

Base 142 of scrap stripper 140 may comprise any rectangular solid or parallelepiped and post 144 may comprise a cylindrical solid, as shown in FIG. 2A. However, those skilled in the art will appreciate that base 142 and post 144 of the present invention are not limited to a particular shape, size, or orientation. Base 142 and/or post 144 may assume the form of any solid or hollow cylinder or polyhedron. For example, as shown in FIG. 3A, scrap stripper 140 may comprise a cubical base 142, oriented on die board 130 in a diamond orientation, with two cylindrical posts 144 positioned along a diagonal of the cubical base. Alternatively, scrap stripper 140 may comprise a cylindrical base 142 with two rectangular posts 144 (see FIG. 3B). In still another embodiment, shown in FIG. 3C, scrap stripper 140 comprises a rectangular base 142 with three cylindrical posts 144. The embodiments illustrated in FIGS. 2A–2B and 3A–3C are for illustration only; those skilled in the art will appreciate that the present invention is not limited to the shape, size, or orientation illustrated therein.

In addition to the various shapes, sizes, and orientations of stripper 140, those skilled in the art will appreciate that the scrap strippers 140 of the present invention are not limited to a particular number of posts 144 per base 142. Typically, the number of posts 144 depends on the size and/or shape of the base 142 of the scrap stripper 140. For example, smaller scrap strippers 140 may include only one or two posts 144 while larger scrap strippers 140 may utilize additional posts 144 to effectively strip the scrap material from the blades.

Referring now to the sequence of drawings illustrated in FIGS. 4A–4F, an exemplary method of stripping cut scrap material from a corrugated board 150 will now be described. FIGS. 4A–4F illustrate the movement of a stripper 140, along with a sheet of corrugated board 150, through nip 115. To simplify this illustration, only a single scrap stripper 140 with a single post 144 is shown in FIGS. 4A–4F. However, those skilled in the art will appreciate that the scrap stripping method described herein may utilize more than one scrap stripper 140 and that each of the scrap strippers 140 may assume a different shape and/or size and include any number of posts 144.

In FIGS. 4A–4F, a pair of cutting blades, 138A and 138B, are disposed adjacent to scrap stripper 140 on die board 130. Cutting blades 138A, 138B function to cut a hole or notch from corrugated board 150 passing through the nip 115. As shown in FIGS. 4A–4F, cutting blades 138A, 138B represent a cross-section of a cutting blade 138 that surrounds scrap stripper 140. However, cutting blade 138 may be part of a cutting blade network surrounding one or more scrap strippers 140, as described above.

Figure 4A:
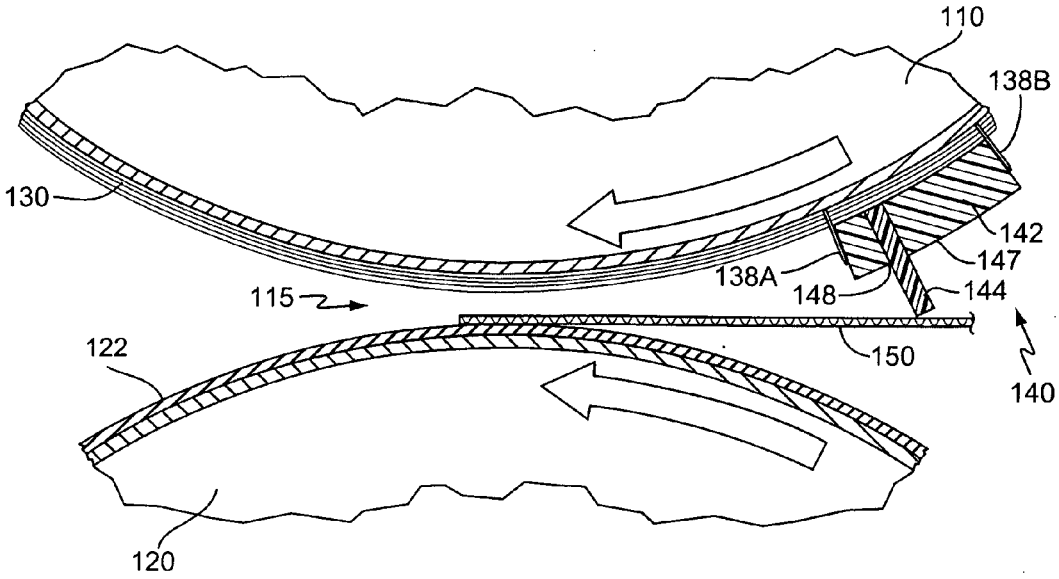
FIGS. 4A–4F illustrate a partial sectional view of a corrugated board rotary cutting die incorporating the compressible scrap stripper of the present invention.

As shown in FIG. 4A, corrugated board 150 feeds into nip 115 as the cutting cylinder 110 rotates clockwise while the anvil 120 rotates counter-clockwise. In FIG. 4A, neither the leading cutting blade 138A nor the rear cutting blade 138B have engaged corrugated board 150. However, the post 144 of scrap stripper 140 has engaged the corrugated board 150 in a scrap area, defined herein as an area on corrugated board 150 that is to be cut and removed from corrugated board 150.

Figure 4B:
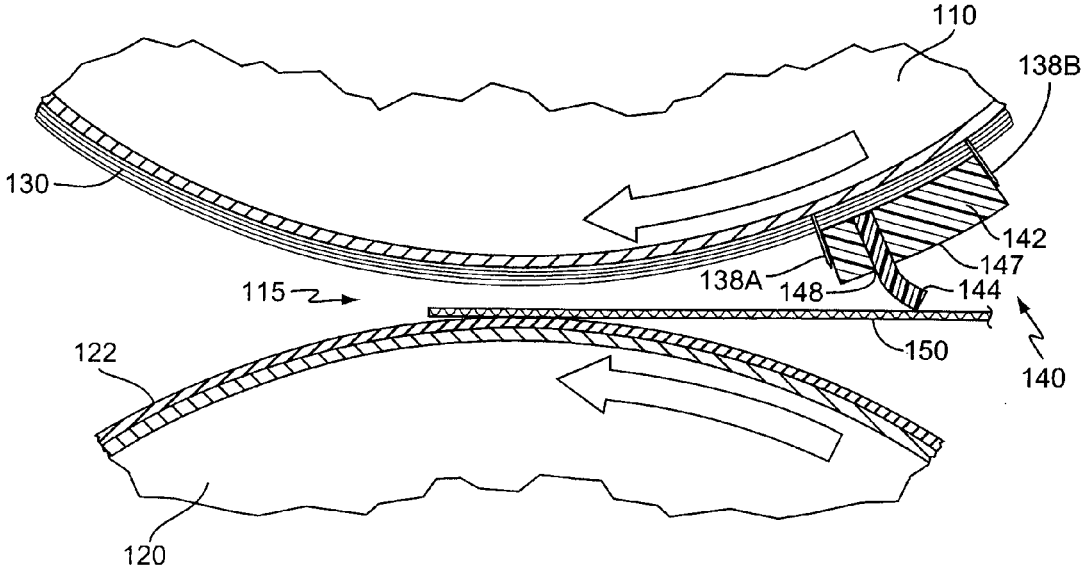
Figure 4C:
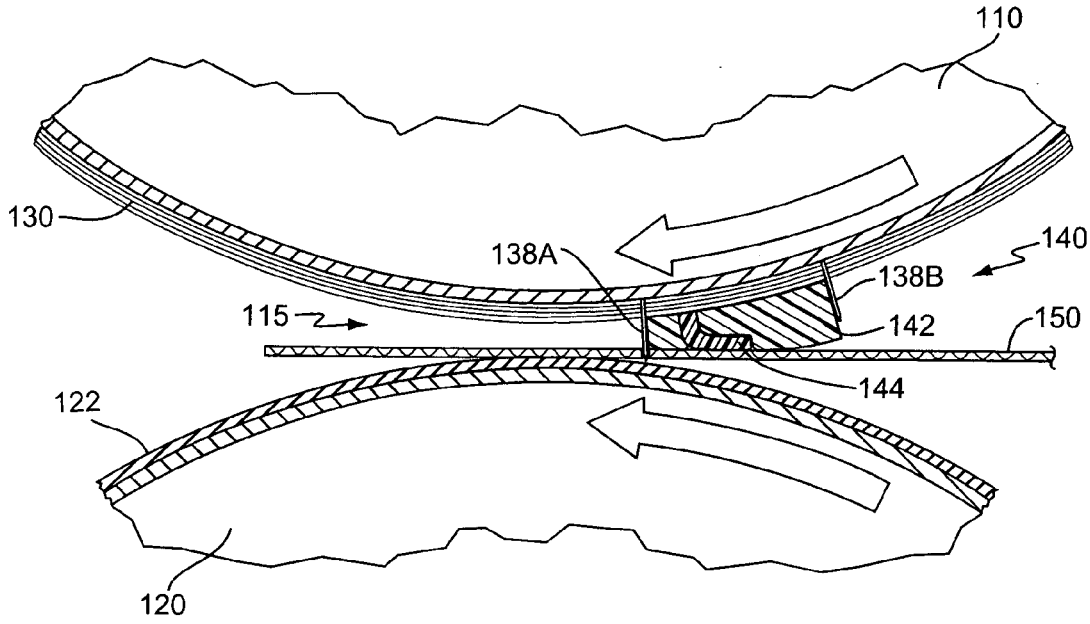

Because the separation between cutting cylinder 110 and anvil 120, which defines the height of nip 115, is less than the height of scrap stripper 140, post 144 flexes towards the base 142 as the scrap stripper 140 enters nip 115 (see FIG. 4B). In FIG. 4B, as post 144 flexes back towards base 142 to an intermediate flexed position, post 144 pushes against the corrugated board 150. While the post 144 is generally flexible enough to flex and compress, as shown in FIGS. 4A–4F, post 144 may also be sufficiently rigid to cause corrugated board 150 to crease where post 144 engages and exerts a downward force against the corrugated board, as discussed further below. As the corrugated board 150 and scrap stripper 140 move further into nip 115, post 144 continues flexing inwardly towards base 142 (FIG. 4C). Further, post 144 and base 142 begin compressing, allowing leading cutting blade 138A to engage and cut through corrugated board 150.

Figure 4D:
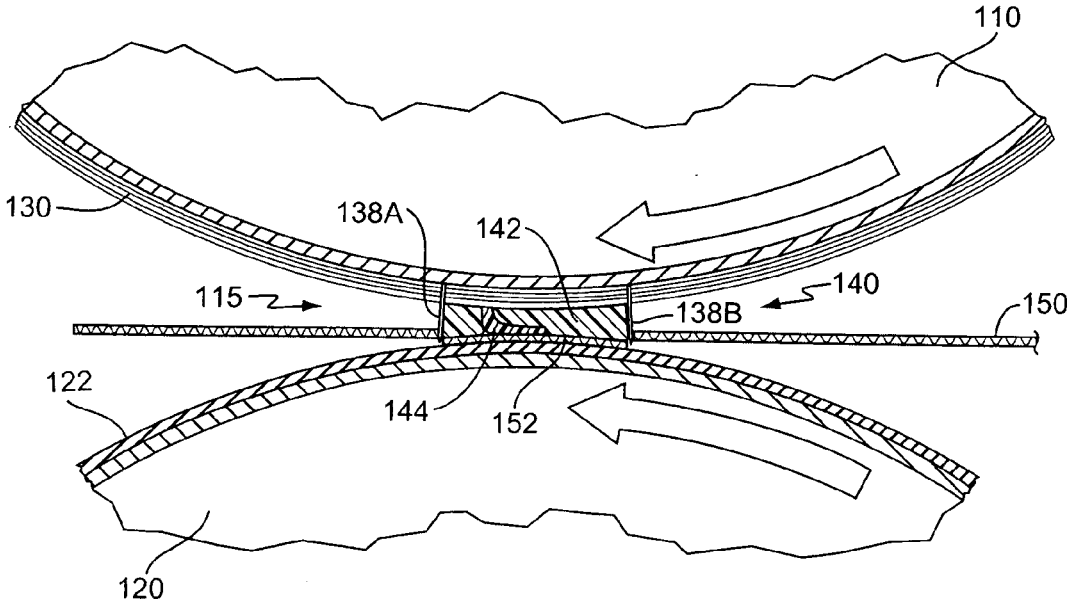
Figure 4E:
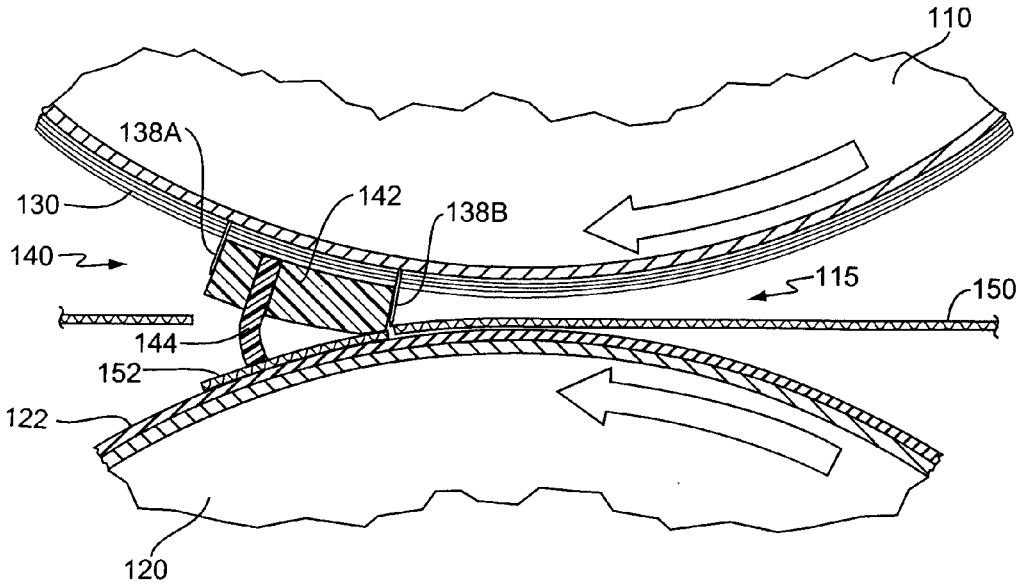
Figure 4F:
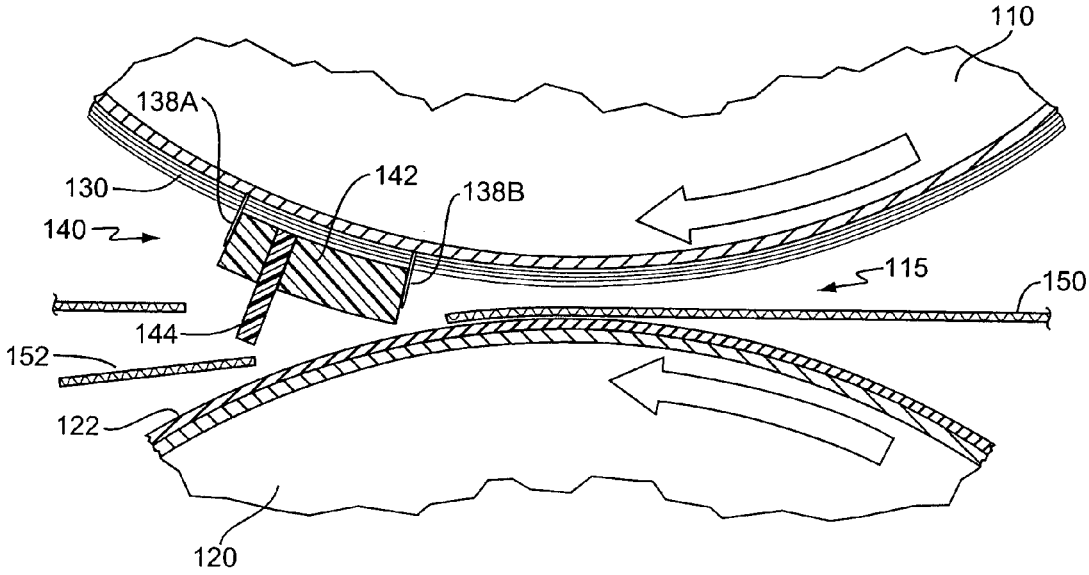

In FIG. 4D, scrap stripper 140 is fully within the nip 115 and is substantially compressed between die board 130 and corrugated board 150. The substantially compressed position of scrap stripper 140 allows both cutting blades 138A, 138B to engage and cut through corrugated board 150, forming scrap piece 152. As the scrap stripper 140 exits nip 115 (FIG. 4E), scrap stripper 140 expands, causing post 144 to expand and flex outwardly away from the base. The expanding and outwardly flexing post 144 continues exerting a downward force on the underlying scrap piece 152 and, as viewed in FIG. 4E, acts (alone or in conjunction with other scrap strippers) to strip scrap piece 152 from cutting blades 138A, 138B. Post 144 maintains contact with scrap piece 152 to continuously engage the cut scrap piece 152 and to hold the cut scrap piece 152 against the anvil 120 until post 144 has returned to the fully extended position. By holding the scrap piece 152 against the anvil 120 with post 144, scrap piece 152 is directed generally downwardly adjacent the downstream side of the anvil, causing the scrap piece to be separated from the final corrugated product. Further, as post 144 returns to the fully extended position, post 144 springs to the fully extended position and ejects scrap piece 152 generally along the trajectory of the anvil 120. By ejecting the scrap piece 152 along the trajectory of anvil 120, post 144 operates to remove the scrap piece 152 from the working area while the final corrugated product continues traveling along a generally horizontal path.

As mentioned above, post 144 may crease scrap piece 152 as the corrugated board 150 and scrap stripper 140 pass through nip 115. FIGS. 5A–5E illustrate the creasing process in further detail, as viewed from an end of the rotary die cutting apparatus 100, as the scrap stripper 140 and corrugated board 150 approach the viewing end. To better illustrate this creasing process, FIGS. 5A–5E, which generally correspond to FIGS. 4A–4F, are exaggerated and are not drawn to scale. Further, as discussed above, cutting blade 138 surrounds scrap stripper 140. However, for illustration purposes, FIGS. 5A–5C only include a cross-section of cutting blade 138, referenced by 138C and 138D.

Figure 5A:
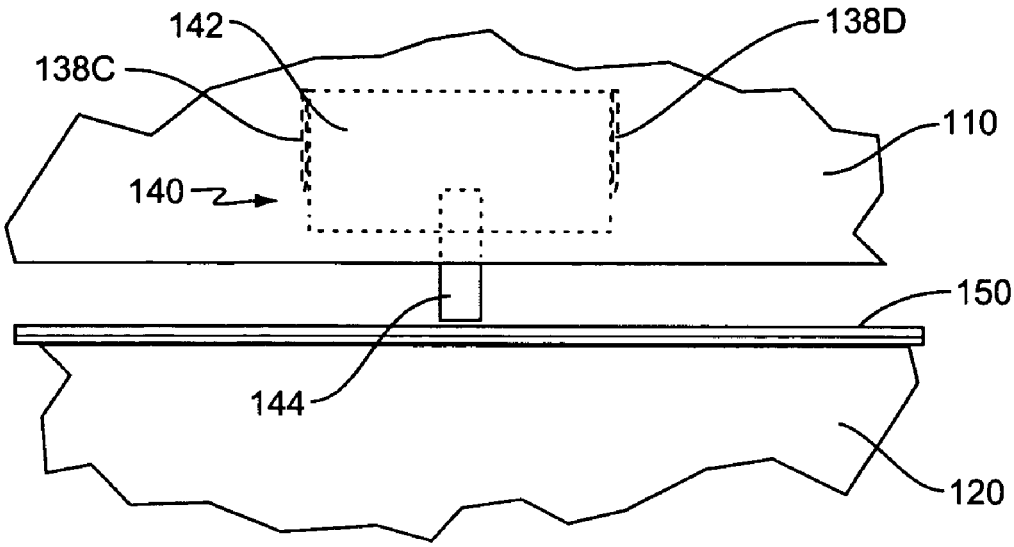
FIGS. 5A–5E schematically illustrate the scrap stripper of the present invention engaging and stripping a piece of scrap from one or more scrap cutting blades as the blank corrugated board is fed through the rotary cutting die.
Figure 5B:
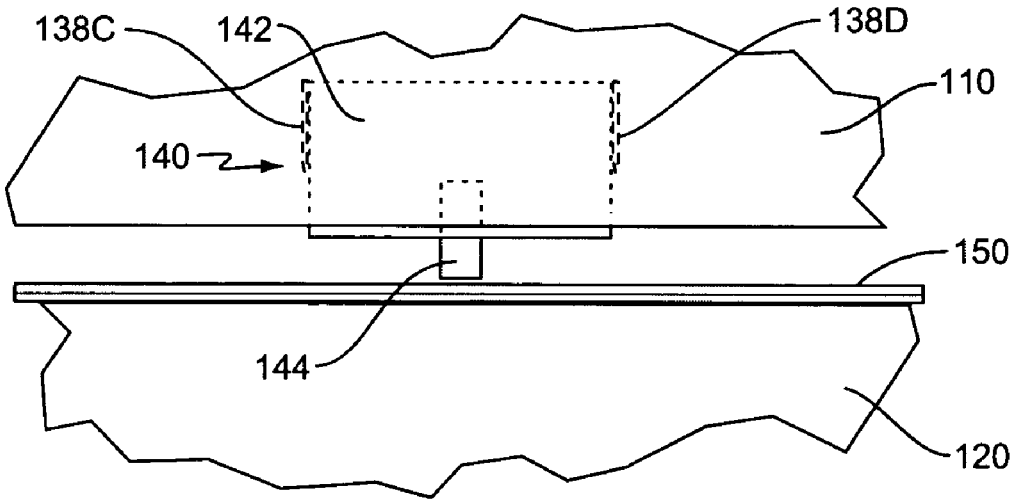
Figure 5C:
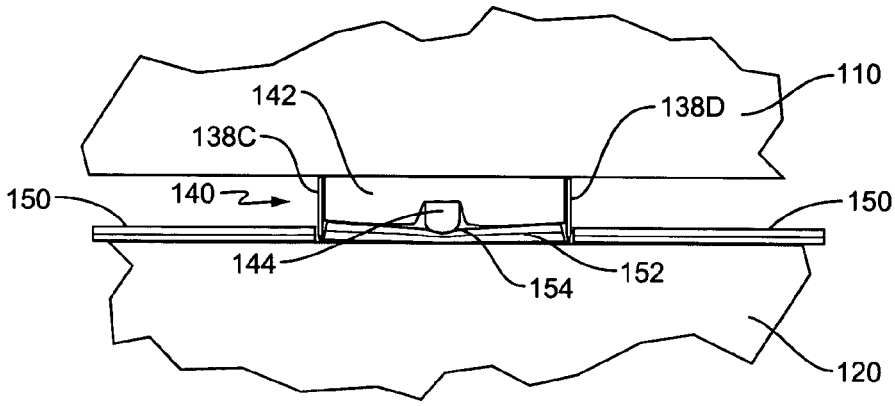
Figure 5D:
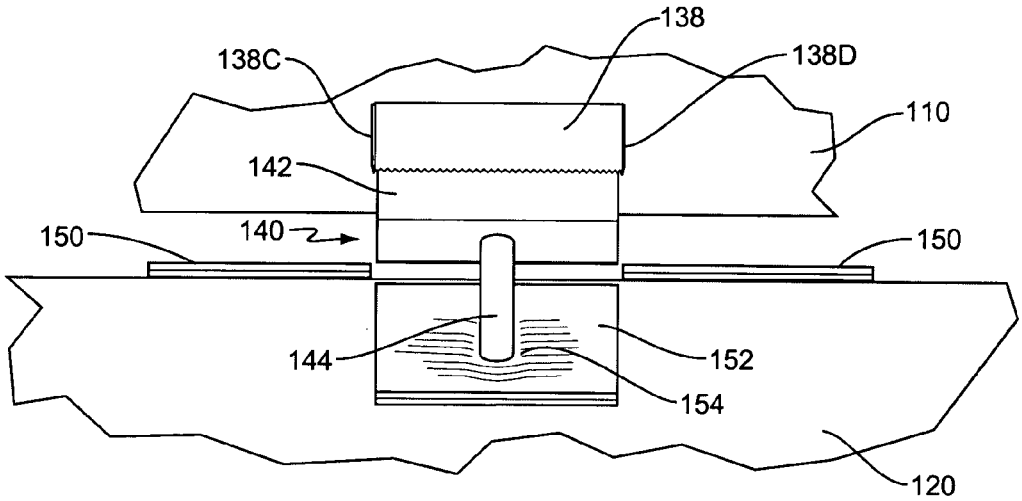
Figure 5E:
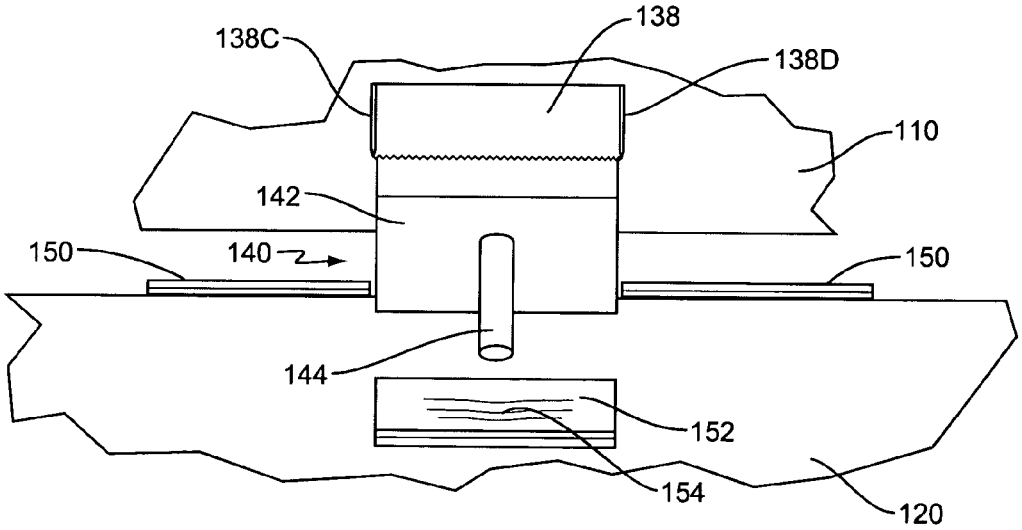

FIG. 5A, which generally corresponds to FIG. 4A, shows the scrap stripper 140 coming into view as scrap stripper 140 and corrugated board 150 enter nip 115. Post 144 engages the scrap area on corrugated board 150 and begins flexing and compressing against the scrap area as corrugated board 150 and scrap stripper 140 continue through nip 115 (see FIG. 5B, which generally corresponds to FIG. 4B). As shown in FIG. 5C, generally corresponding to FIGS. 4C–4D, the compressing base 142 combined with the flexing and compressing post 144 exerts sufficient pressure on the scrap area of the corrugated board 150 to crush the top surface of corrugated board 150, causing a crease 154 to form. The size and depth of crease 154 generally depends on the thickness of the corrugated board 150, the durometer of the post and base material, the size and shape of the post 144, the thickness of base 142, and/or the height of nip 115. Further, cutting blades 138C, 138D cut through corrugated board 150 to form the cut scrap piece 152. As illustrated in exaggerated detail in FIG. 5C, once scrap piece 152 has been cut from the corrugated board 150, the downward pressure exerted by post 144 on crease 154 causes the edges of the cut scrap piece 152 to pull inwardly and away from cutting blades 138C, 138D. Therefore, crease 154 facilitates the scrap stripping process by separating the scrap piece 152 from the cutting blades 138.

As the scrap stripper 140, corrugated board 150, and cut scrap piece 152 begin exiting the nip (FIG. 5D), post 144 begins expanding. As post 144 expands, post 144 continues to push against crease 154 while holding the separated and cut scrap piece 152 against anvil 120. When post 144 returns to the fully extended position, the post 144 of scrap stripper 140 springs outwardly and ejects scrap piece 152 from the work area (FIG. 5E) while the final corrugated board product continues along the horizontal path parallel to the nip 115.

From the foregoing description, it will be appreciated that scrap stripper 140 may perform at least three basic functions. First, scrap stripper 140 acts to strip cut scrap pieces 152 from one or more adjacently disposed cutting blades. Secondly, as the scrap stripper 140 engages and compresses against the scrap area of the corrugated board 150, post 144 may exert sufficient downward pressure on the corrugated board 150 to crease the scrap area. After cutting blades 138 cut through corrugated board 150 to form scrap piece 152, post 144 continues to push on the crease 154, causing at least a portion of scrap piece 152 to pull inwardly and away from cutting blades 138. As such, a crease 154 formed by post 144 facilitates the separation of the scrap piece 152 from the cutting blades 138. Lastly, because of the configuration of the scrap stripper 140 and its ability to extend substantially past the height of any adjacent blades 138, scrap stripper 140, through the flexible post 144, acts to hold the scrap piece 152 against the anvil 120 as the scrap piece 152 moves out of the nip 115. Due to the extension of post 144, the scrap piece 152 is held against the anvil 120 and ejected generally in a downward direction adjacent the downstream side of the anvil 120. As a result, post 144 of scrap stripper 140 generally controls the trajectory of the ejected scrap piece 152 by generally assuring that scrap piece 152 is not directed horizontally out of the nip with the final corrugated product. Instead, scrap piece 152 is directed away from cutting blades 138 and separated from the final corrugated product.

The present invention may be carried out in other specific ways than those set forth herein without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A die board for use on a rotary cutting die that cooperates with a rotary anvil to cut corrugated board directed through a nip defined between the rotary cutting die and the rotary anvil, the die board comprising:

one or more cutting blades secured to the die board for cutting a scrap piece from the corrugated board as the corrugated board passes through the nip; and at least one scrap stripper mounted to the die board adjacent to at least one of the one or more cutting blades for stripping the scrap piece from the one or more cutting blades and the corrugated board as the scrap piece exits the nip, said at least one scrap stripper comprising a compressible base with an opening and a compressible post inserted into the opening and extending from said base, wherein said post is movable between a flexed position and an extended position.

2. The die board of claim 1 wherein said post extends generally perpendicular from said base.

3. The die board of claim 1 wherein said base comprises an outer surface and wherein in the extended position the post extends generally normal to the outer surface.

4. The die board of claim 1 wherein said base includes a plurality of the openings and a plurality of posts extend from the openings.

5. The die board of claim 1 wherein said post is frictionally secured within the opening of said base.

6. The die board of claim 1 wherein said post is secured within the opening of said base with an adhesive.

7. The die board of claim 1 wherein said post assumes the shape of a cylindrical solid, a cylindrical tube, or a polyhedron.

8. The die board of claim 7 wherein said polyhedron assumes the shape of a parallelepiped.

9. The die board of claim 1 wherein said post comprises latex tubing, silicon tubing, tube punch rubber tubing, or white urethane.

10. The die board of claim 1 wherein said base assumes the shape of a cylinder or a polyhedron.

11. The die board of claim 10 wherein said polyhedron assumes the shape of a parallelepiped.

12. The die board of claim 1 wherein said base comprises white urethane.

13. The die board of claim 1 wherein said scrap stripper creases the scrap piece and causes at least a portion of the scrap piece to move away from the one or more cutting blades.

14. The die board of claim 1 wherein said scrap stripper comprises a material with a durometer of 70–95 on a shore 00 scale.

15. The die board of claim 14 wherein said post of said scrap stripper comprises a material with a durometer of 80–90 on a shore 00 scale.

16. The die board of claim 14 wherein said base of said scrap stripper comprises a material with a durometer of 75–85 on a shore 00 scale.

17. A die board for use on a rotary cutting die that cooperates with a rotary anvil to cut corrugated board directed through a nip defined between the rotary cutting die and the rotary anvil, the die board comprising:

one or more cutting blades secured to the die board for cutting a scrap piece from the corrugated board as the corrugated board passes through the nip;

means for creasing the scrap piece and separating the scrap piece from the one or more cutting blades as the corrugated board and scrap piece passes through the nip;

the means for creasing the scrap piece further strips the scrap piece from one or more cutting blades and the corrugated board as the scrap piece exits the nip; and wherein said means for creasing the scrap piece comprises a compressible base with an opening and a compressible post inserted into the opening and extending from said base, wherein said post is movable between flexed and extended positions.

18. The die board of claim 17 wherein said base comprises an outer surface and wherein in the extended position the post extends generally normal to the outer surface.

19. The die board of claim 17 wherein the means for creasing the scrap piece causes an outer edge portion of the scrap piece to move away from the one or more cutting blades, therefore facilitating the stripping of the scrap piece from the one or more blades.

20. A die board for use on a rotary cutting die that cooperates with a rotary anvil to cut corrugated board directed through a nip defined between the rotary cutting die and the rotary anvil, the die board comprising:

one or more cutting blades secured to the die board for cutting a scrap piece from the corrugated board as the corrugated board passes through the nip;

at least one scrap stripper mounted to the die board adjacent to at least one of the one or more cutting blades for stripping the scrap piece from the one or more cutting blades and the corrugated board as the scrap piece exits the nip, said at least one scrap stripper comprising a compressible base with an outer surface and a compressible post extending generally normal from the outer surface of said base;

wherein said base comprises an opening and wherein said post inserts into and extends from the opening.

21. The die board of claim 20 wherein said base includes a plurality of spaced apart openings and a plurality of posts extending from the spaced apart openings.

* * * * *